US005699929A

United States Patent [19]

Ouno

[11] Patent Number: 5,699,929

[45] Date of Patent: Dec. 23, 1997

[54] GARBAGE CONTAINER

[76] Inventor: Taiichi Ouno, 5-28, Biwajima 2-chome, Nishi-ku, Nagoya-shi, Aichi-ken, Japan

[21] Appl. No.: 622,361

[22] Filed: Mar. 25, 1996

[51] Int. Cl.[6] ..... B65D 45/28

[52] U.S. Cl. ..... 220/323; 220/908

[58] Field of Search ..... 220/324, 323, 220/908

[56] References Cited

U.S. PATENT DOCUMENTS

| | | | |
|---|---|---|---|
| 2,111,359 | 3/1938 | Curtis | 220/908 X |
| 2,974,990 | 3/1961 | Mereness | 220/323 X |
| 4,320,851 | 3/1982 | Montoya | 220/323 X |
| 4,351,446 | 9/1982 | Madden | 220/323 X |
| 4,384,656 | 5/1983 | McQuiston et al. | 220/323 |
| 4,489,851 | 12/1984 | Russ | 220/323 |

*Primary Examiner*—Steven M. Pollard
*Attorney, Agent, or Firm*—Parkhurst, Wendel & Burr, L.L.P

[57] ABSTRACT

A garbage container including a body member for containing garbage therein, the body member having an upper opening; a lid member for closing the upper opening of the body member, the lid member having a handle provided on an upper surface thereof, the handle being gripped with a hand of a user for moving the lid member to close or open the upper opening of the body member; an engageable member which is provided on one of the body member and the lid member and which is engageable with the other of the body member and the lid member to prevent the lid member from separating from the body member; and an operable member which is operable by the user for moving or displacing the engageable member between an engaged position where the engageable member is engaged with the other of the body member and the lid member and a disengaged position where the engageable member is disengaged from the other of the body member and the lid member, the operable member being provided on, or in a vicinity of, the handle.

9 Claims, 8 Drawing Sheets

GARBAGE CONTAINER

BACKGROUND OF THE INVENTION

1. Field of the Invention

The present invention relates to a garbage container including a body member and a lid member and particularly to the art of engaging and disengaging the lid member with and from the body member.

2. Related Art Statement

There is known an outdoor-use garbage container including a body member for containing garbage therein, and a lid member which is attached to an upper end of the body member for closing an upper opening of the body member. The lid member has a handle provided on an outer or upper surface thereof, and the handle is gripped with one hand of a user for moving the lid member to close or open the upper opening of the body member.

FIG. 8 shows an example of the known garbage container. The prior garbage container 152 includes a body member 112 which has a box-like configuration with a bottom wall and an upper opening, and a lid member 114 which has a handle 122 provided at a generally central location of an outer or upper surface thereof. Two bearing members 156, 156 are supported by respective upper portions of the body member 112 which are opposed to each other in a first horizontal direction. The two bearings 156, 156 respectively bear two axis members 154, 154 which extend in a second horizontal direction perpendicular to the first horizontal direction, i.e., perpendicular to the sheet of the drawing. Two engagement members 158, 158 are respectively supported by the two bearing members 156, 156 such that the engagement members 158 are rotatable about the axis members 154, 154, respectively.

In the prior garbage container 152, with the upper opening of the body member 112 being closed with the lid member 114, each of the engagement members 158 is rotated upward about a corresponding axis member 154 and is engaged with the upper surface of the lid member 114, so that the lid member 114 is sandwiched under pressure between the upper end face of the body member 112 and the two engagement members 158, 158. Thus, the lid member 114 is effectively prevented from freely separating from the body member 112.

However, when a user engages or disengages the engagement members 158 with or from the lid member 114, he or she must hold down the lid member 114 with one hand and rotate each of the engagement members 158 with the other hand, or must simultaneously rotate the two engagement members 158. In either case, the user must use both hands. Accordingly, when the user puts garbage in the container, he or she cannot open the lid member 114 while keeping the garbage in his or her hand. Thus, the prior garbage container suffers from the problem of low ease of use.

SUMMARY OF THE INVENTION

It is therefore an object of the present invention to provide a garbage container including a lid member, a body member, and an engageable member which is easily engageable with, and disengageable from, the lid or body member with one hand of a user and accordingly enjoys improved ease of use.

The above object has been achieved according to the present invention, which provides a garbage container comprising a body member for containing garbage therein, the body member having an upper opening; a lid member for closing the upper opening of the body member, the lid member having a handle provided on an upper surface thereof, the handle being gripped with a hand of a user for moving the lid member to close or open the upper opening of the body member; at least one engageable member which is provided on one of the body member and the lid member and which is engageable with the other of the body member and the lid member to prevent the lid member from separating from the body member; and an operable member which is operable by the user for moving or displacing the engageable member between an engaged position where the engageable member is engaged with the other of the body member and the lid member and a disengaged position where the engageable member is disengaged from the other of the body member and the lid member, the operable member being provided on, or in a vicinity of, the handle.

In the garbage container constructed as described above, a user can very easily engage or disengage, when moving the lid member to close or open the upper opening of the body member, the engageable member with or from the lid or body member, by using one hand for gripping the handle of the lid member and using a finger of the gripping hand for operating the operable member to move or displace the engageable member to the engaged or disengaged position. Thus, in the garbage container, the engageable member can easily be engaged with, and disengaged from, the lid or body member with one hand of the user. Accordingly, for example, the user can easily open the lid member with one hand while simultaneously keeping garbage in the other hand. Thus, the present garbage container is easier to use.

In a preferred embodiment of the present invention, the at least one engageable member comprises a plurality of engageable members, a first one of the engageable members being movable or displaceable between the engaged and disengaged positions. In this embodiment, the engagement of the engageable member with the lid or body member is performed with high reliability.

In another embodiment of the present invention, the first one of the engageable members is provided at a first position on a peripheral portion of the lid member, such that the first engageable member is movable or displaceable between the engaged and disengaged positions, and a second one of the engageable members is fixed at a second position on the peripheral portion of the lid member, the second position being substantially symmetrical with the first position with respect to a center of the lid member, each of the first and second engageable members being engageable with an upper portion of the body member which portion defines the upper opening. The first and second engageable members engage the upper portion of the body member, at respective positions which are symmetrical with each other with respect to a center of the body member. Thus, the lid member is effectively prevented from freely separating from the body member. Since only the first engagement member out of the first and second engagement members is movable or displaceable, the operable member has only to move or displace fewer engageable members. In addition, the fixed, second engagement member enjoys a simple construction.

In another embodiment of the present invention, the upper portion of the body member comprises an outwardly protruding flange, each of the first and second engageable members including a hook portion which is engageable with the flange, the first engageable member being provided on the lid member such that the hook portion of the first engageable member is movable outward over an outer peripheral edge of the lid member by a predetermined distance. In this embodiment, the engageable members are engaged with, and disengaged from, the body member with high reliability and stability.

In another embodiment of the present invention, the first engageable member includes, in addition to the hook portion thereof provided on the peripheral portion of the lid member, an operational portion extending from the hook portion thereof toward the handle of the lid member, the operable member being operable for moving the operational portion and thereby moving the first engageable member between the engaged and disengaged positions. In this embodiment, the movable, first engageable member enjoys a simple construction.

In another embodiment of the present invention, the hook portion of at least one of the first and second engageable members has an inclined or curved guide surface which is inclined downward in an outward direction in which the flange of the body member protrudes. In this embodiment, when the lid member is attached to an upper end of the body member to close the upper opening of the same, the hook portion or portions of the first and/or second engageable members is/are guided by the inclined or curved guide surface or surfaces contacting the upper end of the body member, so that the two engagement members are smoothly engaged with the flange of the body member. Thus, the upper opening of the body member is easily closed with the lid member.

In another embodiment of the present invention, the garbage container further comprises a biasing device which biases the engageable member in a direction in which the engageable member is moved or displaced toward the engaged position. In this embodiment, owing to the biasing force of the biasing device, the stable engagement of the engageable member with the lid or body member is maintained with reliability, and the lid member is effectively prevented from freely separating from the body member. The lid member is easily attached to the body member by operating the operable member to move or displace the engageable member to the disengaged position, subsequently placing the lid member on the upper end of the body member, and then stopping the operation of the operable member. Consequently the engageable member is immediately moved or displaced to the engaged position owing to the biasing force of the biasing device. That is, simultaneously with the attachment of the lid member to the body member, the engageable member is engaged with the body member with reliability, without needing any special operation of the user. In the case where the biasing device biases the above-mentioned movable, first engageable member and the hook portion of the first engageable member has the above-mentioned inclined or curved guide surface, the first engageable member is moved, first, from the engaged position to the disengaged position against the biasing force of the biasing device and, then, from the disengaged position to the engaged position owing to the biasing force, by just pushing down the lid member against the body member, with the inclined or curved guide surface of the hook portion of the first engageable member being held in contact with the upper end face of the flange of the body member. Thus, the lid member is smoothly attached to the body member, without needing the operation of the operable member. At the same time, the first engageable member is engaged with the flange of the body member with reliability. Thus, the present garbage container provides even further improved ease of use.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
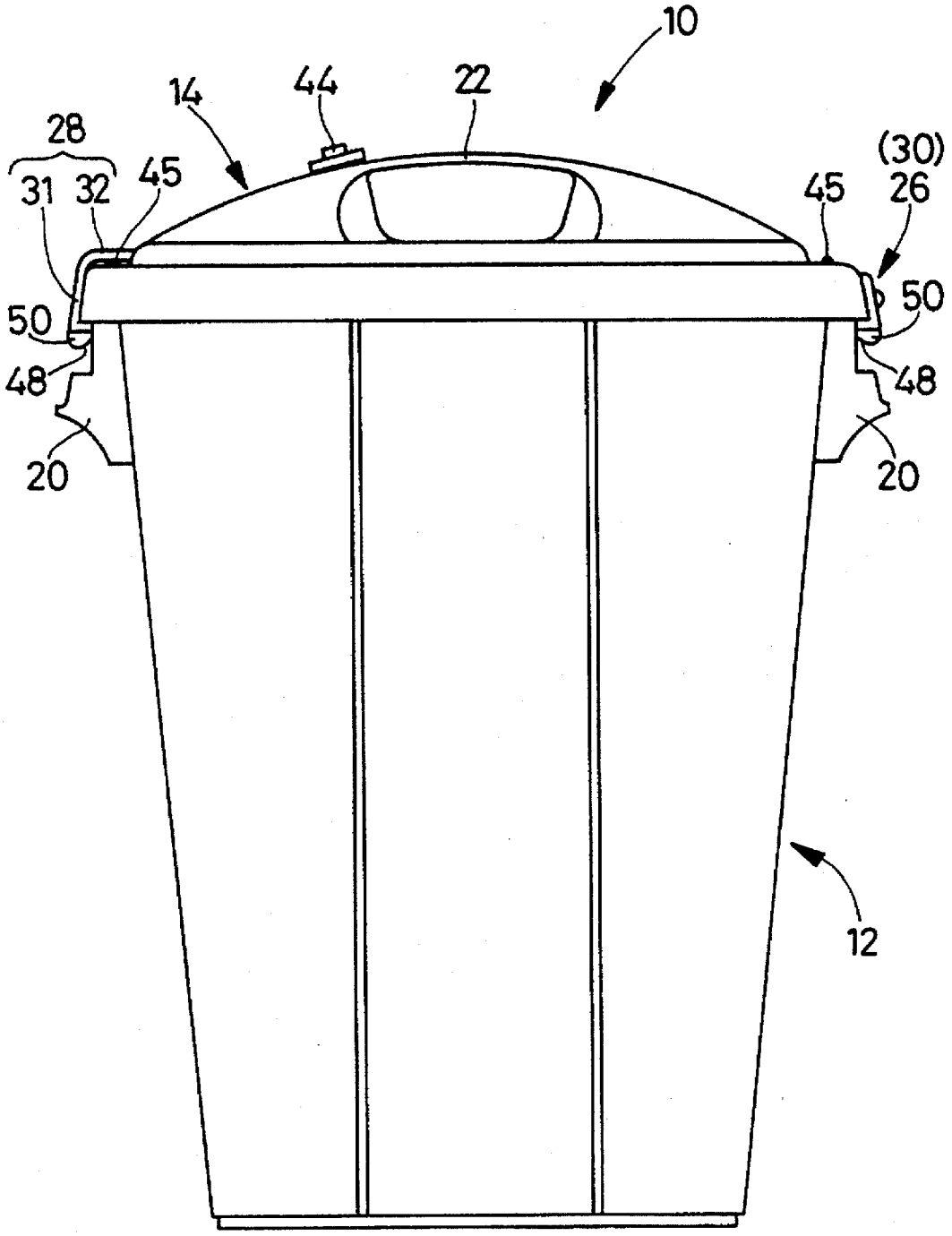
FIG. 1 is a front elevation view of a garbage container embodying the present invention.
Figure 2:
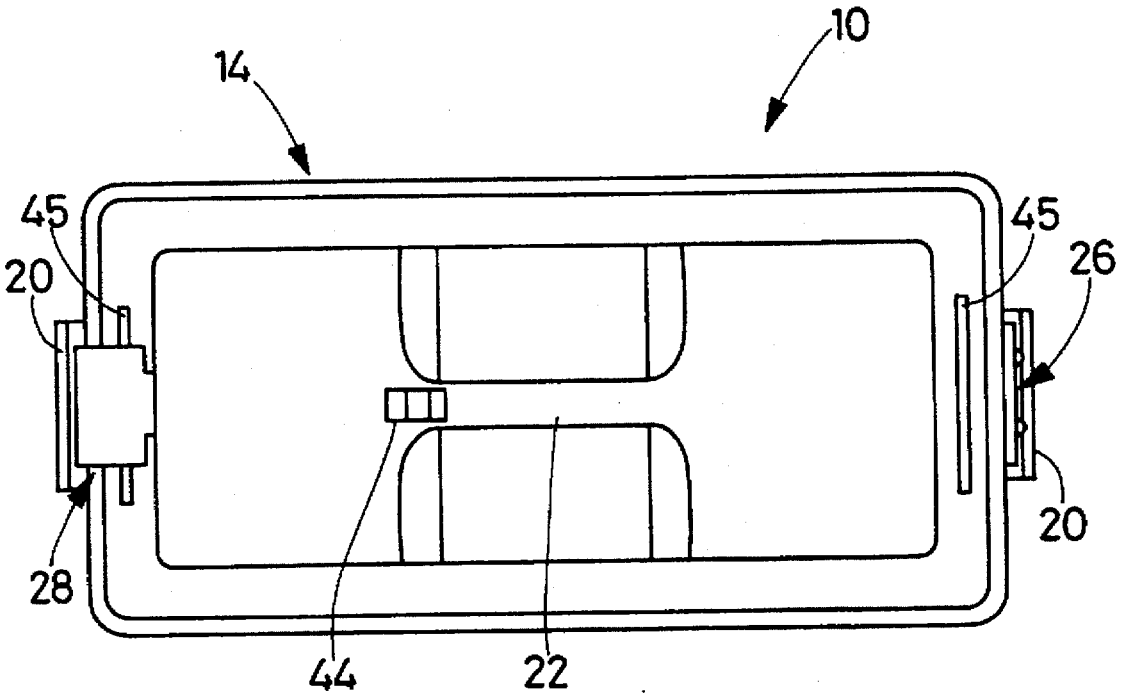
FIG. 2 is a plan view of the garbage container of FIG. 1.

Referring first to FIGS. 1 and 2, there is illustrated a garbage container 10 embodying the present invention. As can be seen in the figures, the container 10 includes a body member 12 and a lid member 14, and has a box-like configuration with a generally rectangular cross section.

Figure 3:
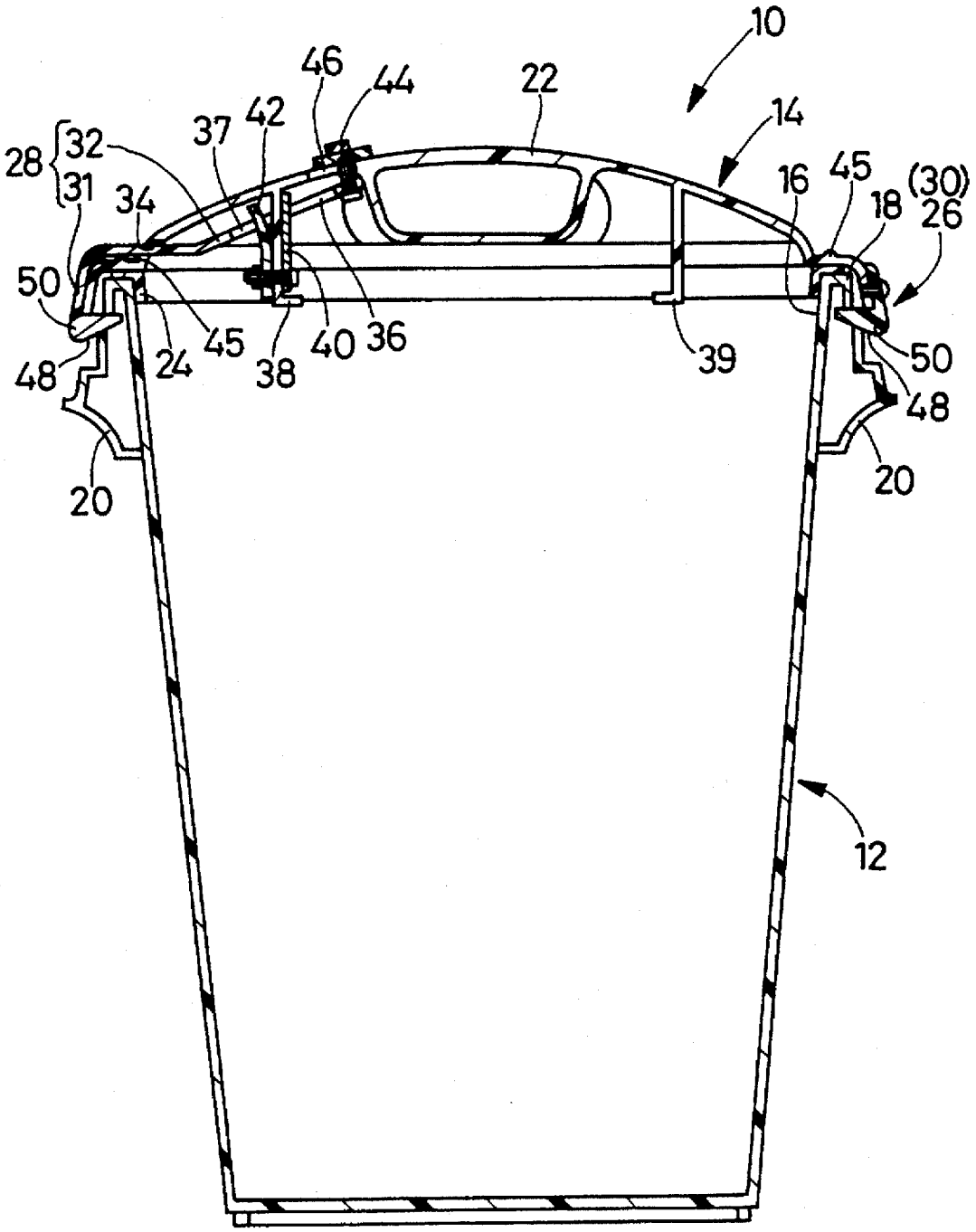
FIG. 3 is a cross-section elevation view of the garbage container of FIG. 1.

More specifically, the body member 12 of the container 10 is formed of a synthetic resin and has, as shown in FIG. 3, a box-like configuration with an upper opening 16 and a bottom wall. The body member 12 can contain garbage which is put therein through the upper opening 16 by a user. A flange 18 protrudes horizontally outward and then vertically downward, from an entire, upper end of the body member 12, thereby surrounding the upper opening 16. The flange 18 is integrally formed with the body member 12. In FIG. 3, reference numerals 20, 20 denote a pair of body handles which are adapted to be gripped by the user to lift and move the body member 12 or the garbage container 10 as a whole.

The lid member 14 is wider than the upper opening 16 and flange 18 of the body member 12, and has a generally rectangular, dish-like configuration corresponding to that of the body member 12, as shown in FIG. 2. In a generally middle portion of an upper surface of the lid member 14, there is provided a bridge-like handle 22 which extends parallel to a pair of opposite long sides of the lid member 14. The handle 22 is integrally formed with the lid member 14. The user can grip the handle 22 and move the lid member 14 to close or open the upper opening 16 of the body member 12.

A frame member 24 formed of a synthetic resin is provided on the entire upper end of the body member 12. When the lid member 14 is placed on the body member 12 and two engagement members 26, 28 (described later) are engaged with the flange 18 of the body member 12, the frame member 24 is sandwiched between the body member 12 and the lid member 14, thereby effectively preventing the lid member 14 from rattling on the body member 12.

As shown in FIG. 2, the fixed engagement member 26 and the movable engagement member 28 are provided symmetrically at generally middle positions of a pair of opposite short sides of the lid member 14, respectively. Each of the engagement members 26, 28 is formed of a synthetic-resin-based plate having a prescribed width. The fixed engagement member 26 is provided by a hook member 30 having a generally L-shaped cross section. The hook member 30 includes a lower portion which extends horizontally inward by a prescribed length over a lower end of an outer peripheral portion of the lid member 14. An upper portion of the hook member 30 is fixed to the outer surface of the lid member with vis screws. Thus, the hook member 30 as the fixed engagement member 26 is fixed at the middle position of one short side of the peripheral portion of the lid member 14.

Figure 4:
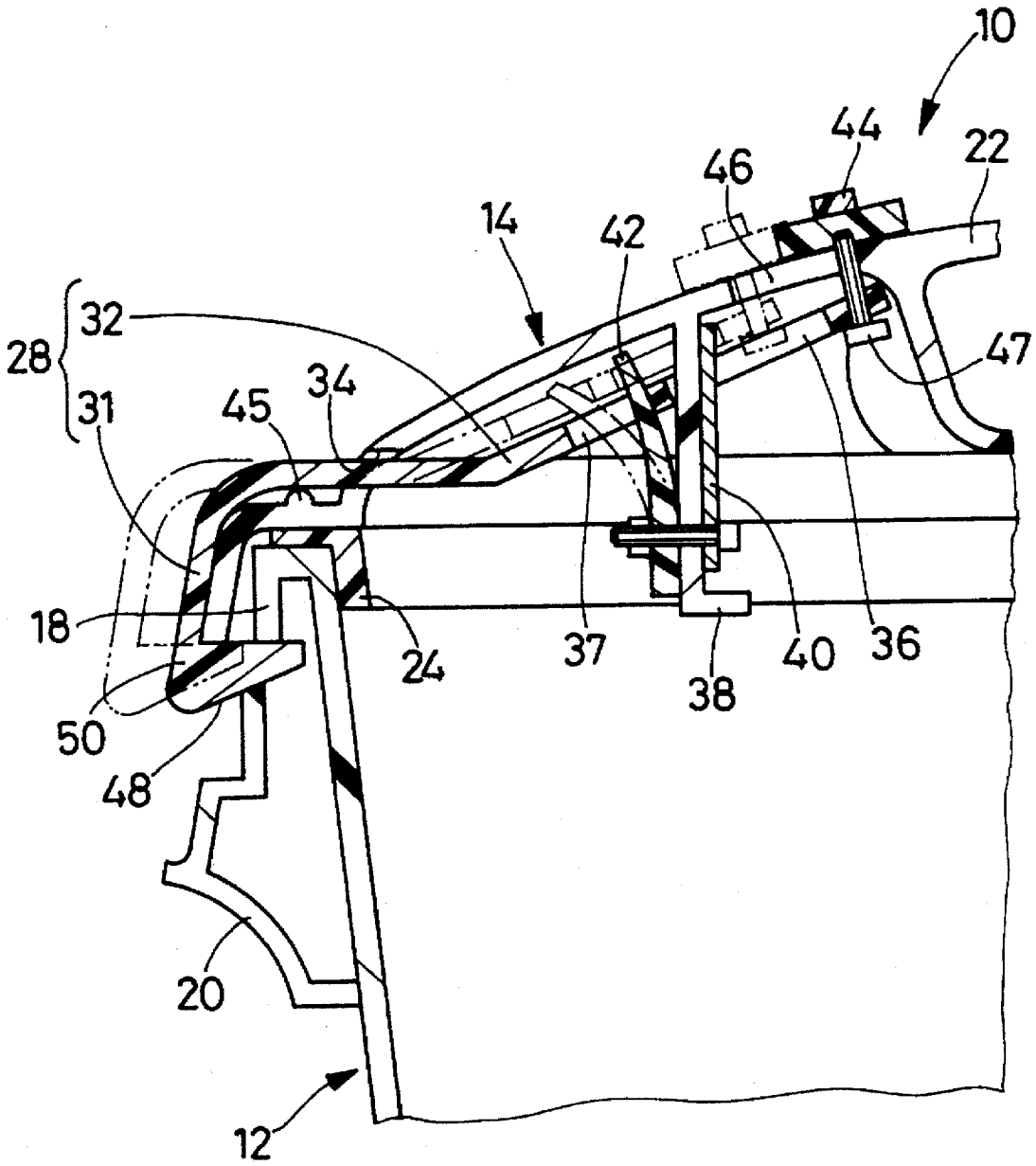
FIG. 4 is an enlarged cross-section elevation view of an essential portion of the garbage container of FIG. 1.

As shown in FIGS. 3 and 4, the movable engagement member 28 includes a hook portion 31 having a shape similar to that of the hook member 30 as the fixed engagement member, and an operational portion 32 which extends from an upper end of an upper portion of the hook portion 31 in substantially the same direction in which a lower portion of the same 31 extends. The operational portion 32 has a width smaller than that of the hook portion 31. The hook portion 31 and the operational portion 32 are integrally formed with each other. At a position on the peripheral portion of the lid member 14 which is generally symmetrical with the position where the fixed engagement member 26 is provided, the lower portion of the hook portion 31 extends horizontally inward over the lower end of the peripheral portion of the lid member 14. The operational portion 32 extends from the outside to the inside through a through-hole 34 formed through the thickness of the peripheral portion of the lid member 14. The operational portion 32 further extends along the inner surface of the lid member 14, up to a location where the handle 22 is provided.

The operational portion 32 of the movable engagement member 28 has two through-holes 36, 37 each of which is formed through the thickness thereof and which have respective prescribed lengths. The first through-hole 36 is provided on the side of the handle 22, and the second through-hole 37 is provided on the side of the hook portion 31. The lid member 14 has two hanging projections 38, 39 which are provided on the lower or inner side thereof and on both sides of the handle 22, respectively, and which are integrally formed therewith. Each hanging projection 38, 39 is used to hang the lid member 14 on, e.g., the flange 18 of the body member 12. The first hanging projection 38 extends through the first through-hole 36 of the operational portion 32 of the movable engagement member 28. A sheet-like spring 42 formed of a synthetic resin and a reinforcement metal plate 40 are fixed, with a vis screw, to opposite surfaces of the first hanging projection 38, respectively. More specifically, a lower end portion of the sheet-like spring 42 is fixed to one of the opposite surfaces of the first projection 38 which one surface is opposed to the hook portion 31 of the movable engagement member 28. An upper end portion of the sheet-like spring 42 extends through the second through-hole 37 of the operational portion 32 on the side of the hook portion 31.

In the vicinity of the handle 22 on the upper side of the lid member 14, there is provided a slide member 44 which includes a large and a small plate having respective thickness values. The slide member 44 is movable or slideable in an outward direction of the lid member 14, i.e., direction from the handle 22 toward the movable engagement member 28. The lid member 14 has, under the slide member 44, an elongate guide hole 46 which is formed through the thickness thereof and which extends over a prescribed length between the location where the handle 22 is provided and the location where the movable engagement member 28 is provided. The slide member 44 is connected, via a vis member which extends through the guide hole 46, to an upper end of the operational portion 32 of the movable engagement member 28, near the handle 22, on the inner side of the lid member 14.

In the garbage container 10 constructed as described above, the operational portion 32 of the movable engagement member 28 is supported by the slide member 44 and a portion of the lid member 14 which defines the through-hole 34 and, when the slide member 44 is moved outward of the lid member 14, in the guide hole 46, with the thumb or finger of one hand of the user, the hook portion 31 can be moved outward from the outer peripheral edge of the lid member 14 by a distance equal to the length of the first elongate hole 36 through which the first hanging projection 38 extends, or equal to the length of the guide hole 46 provided directly below the slide member 44. When the hook portion 31 is moved outward of the lid member 14, the hook portion 31 or the movable engagement member 28 is biased inward of the lid member 14 with the biasing force produced by the sheet-like spring 42 extending through the second hole 37.

Thus, the movable engagement member 28 is movable between an engaged position where the hook portion 31 thereof is engageable with the flange 18 provided at the upper end of the body member 12 and an outwardly distant disengaged position where the hook portion 31 is disengaged from the flange 18, while the movable engagement member 28 is biased to move toward the engaged position by the sheet-like spring 42. Thus, in the present embodiment, the sheet-like spring 42 provides an element of a biasing device which biases the movable engageable member 28 in the inward direction in which the member 28 is moved toward the engaged position, and the slide member 44 provides an operable member which is operable by the user for moving the engageable member 28 between the engaged and disengaged positions.

As shown in FIG. 2, there are provided two guide members 45, 45 near the fixed and movable engagement members 26, 28 in the peripheral portion of the lid member 14. Each guide member 45 has a prescribed height and a prescribed length. Thus, the movable engagement member 28 can easily be moved on the upper surface of the lid member 14 such that the operational portion 32 thereof slides on one of the guide members 45.

In the present embodiment, each of the hook member 30 and the hook portion 31 of the two engagement members 26, 28 includes a guide portion 50 having an inclined guide surface 48 which is inclined downward in the outward direction of the lid member 14.

Thus, the user can easily attach the lid member 14 to the body member 12 by using only one hand to grip the handle 22, moving the lid member 14 relative to the body member 12 such that the respective guide surfaces 48, 48 of the hook member and portion 30, 31 of the two engageable members 26, 28 contact respective portions of the upper end face of the flange 18 of the body member 12, and pushing down the lid member 14. Consequently the hook member and portion 30, 31 are advantageously guided by the guide surfaces 48, 48 contacting the flange 18, so that the hook member 30 of the fixed engagement member 26 engages the flange 18 and the hook portion 31 of the movable engagement member 28 moves outward of the lid member 14 against the biasing force of the sheet-like spring 42, then moves inward by the biasing force, and engages the flange 18. Thus, in the garbage container 10, the lid member 14 is effectively prevented from freely separating from the body member 12.

As indicated by the two-dot chain lines in FIG. 4, when the lid member 14 is removed from the upper opening 16 of the body member 12, the user grips the handle 22 with his or her hand and moves with the thumb or finger of that hand the slide member 44 provided in the vicinity of the handle 22, against the biasing force of the sheet spring 42, in the outward direction of the lid member 14. Consequently the movable engagement member 28 is moved outward of the lid member 14 and the hook portion 31 is moved to the disengaged position where the hook portion 31 is disengaged from the flange 18. In this situation, the lid member 14 can be lifted up and separated from the body member 12.

Figure 8:
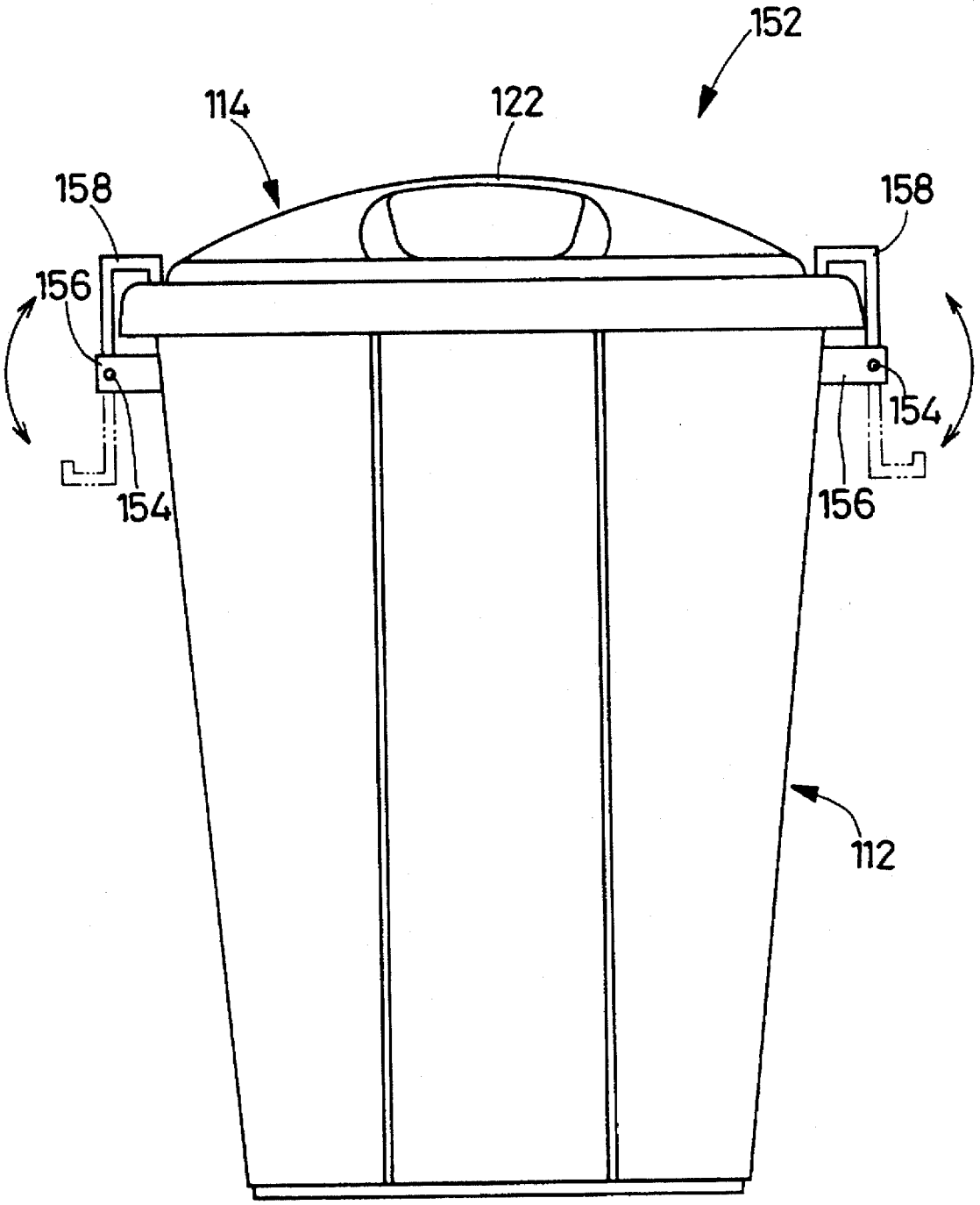
FIG. 8 PRIOR ART
FIG. 8 is a view corresponding to FIG. 1, showing a prior garbage container.

As is apparent from the foregoing description, the garbage container 10 in accordance with the present embodiment enables the user to engage and disengage the movable engagement member 28 (and the fixed engagement member 26) with and from the body member 12 by just moving, with the thumb or finger of his or her one hand gripping the handle 22, the slide member 44 provided in the vicinity of the handle 22, relative to the lid member 14. Thus, the ease of use of the garbage container 10 is much improved as compared with, e.g., the prior garbage container 152 shown in FIG. 8.

In addition, in the garbage container 10, the flange 18 is provided at the upper end of the body member 12 which defines the upper opening 16, and the fixed and movable engagement members 26, 28, each provided on the lid member 14, include the hook member 30 and the hook portion 31 which are engageable with opposite portions of the flange 18, respectively. The movable engagement member 28 can be moved to project outward over the outer peripheral edge of the lid member 14, by a length equal to the length of the first elongate hole 36 of the operational portion 32 of the movable engagement member 28, or the length of the guide hole 46 of the lid member 14. Thus, the engagement and disengagement of the two engageable members 26, 28 with and from the body member 12 can be performed with high reliability and stability.

Furthermore, in the garbage container 10, the fixed engagement member 26 is fixed in position relative to the lid member 14, and the movable engagement member 28 is provided at a position symmetrical with the position where the fixed member 26 is provided, with respect to the center of the lid member 14, such that the movable member 28 is movable between the engaged position where the member 28 is engageable with the flange 18 of the body member 12 and the disengaged position where the member 28 is disengaged from the flange 18. Thus, the lid member 14 is advantageously attached to the body member 12 with high stability. In addition, since only one of the two engagement members 26, 28 is movable between the engaged and disengaged positions, the present garbage container 10 enjoys a simple construction than the case where each of a plurality of engagement members would be movable.

In the present garbage container 10, the movable engagement member 28 includes the hook portion 31 that is engageable with the flange 18 of the body member 12 and the operational portion 32 that is connected to the slide member 44 provided in the vicinity of the handle 22 of the lid member 14. As the slide member 44 is moved by the user, the engagement member 28 is moved between the engaged and disengaged positions. Thus, the movable engagement member 28 enjoys a very simple arrangement.

The present garbage container 10 employs the sheet-like spring 42 that biases the movable engagement member 28 in the direction in which the member 28 is moved toward the engaged position. Thus, the engagements of the hook member and portions 30, 31 of the fixed and movable engagement members 26, 28 with the flange 18 of the body member 12 can be maintained with high stability.

Moreover, in the present garbage container 10, the hook member and portions 30, 31 of the fixed and movable engagement members 26, 28 have the respective inclined guide surfaces 48, 48 that help the user engage the two engageable members 26, 28 with the flange 18 of the body member 12 by just pushing down the lid member 14 against the body member 12 without needing to move the slide member 44. Thus, the lid member 14 is easily attached to the body member 12, and the ease of use of the garbage container 10 is still more improved.

While in the garbage container 10 in accordance with the first embodiment shown in FIGS. 1–4 the sheet-like spring 42 that applies the biasing force to the movable engagement member 28 in the direction in which the member 28 is moved toward the engaged position in which the member 28 is engageable with the flange 18 of the body member 12, is fixed with the vis to the first hanging projection 38 projecting from the inner or lower surface of the lid member 14, the biasing spring 42 and the hanging projection 38 may be replaced by a single, integrally formed member which projects from a prescribed location on the inner surface of the lid member 14, as described below.

Figure 5:
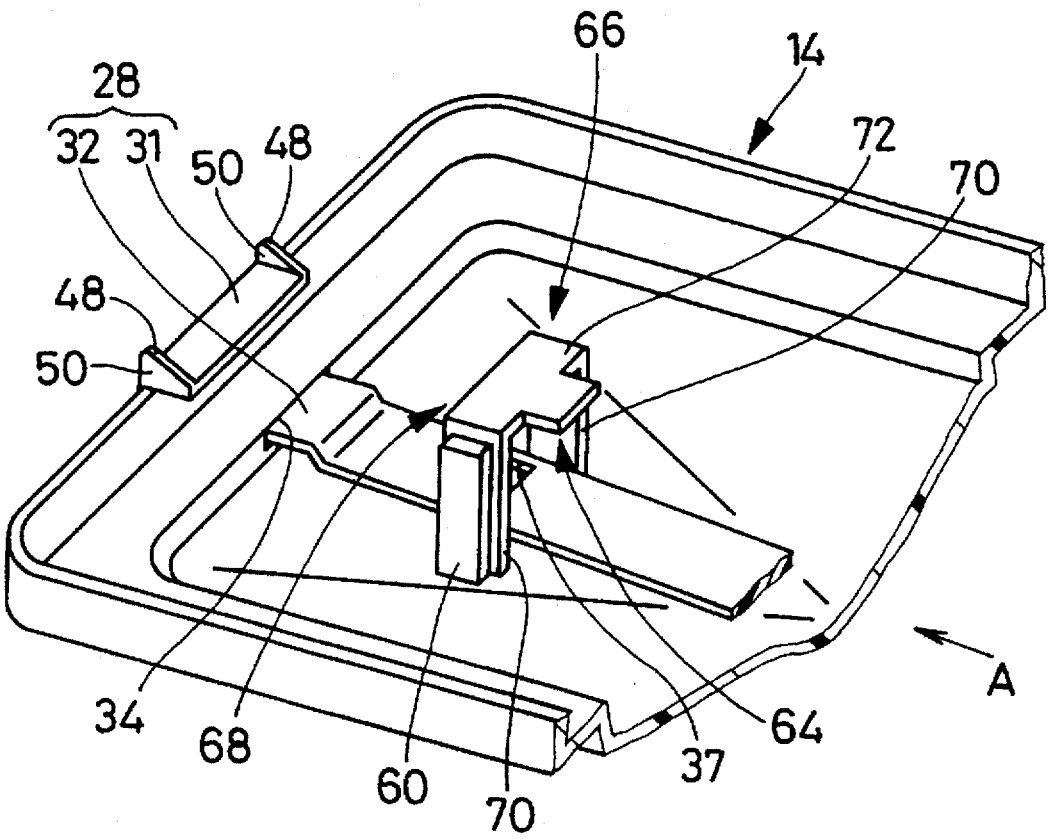
FIG. 5 is an enlarged view of an interior construction of an essential portion of a lid member of another garbage container as a second embodiment of the present invention.
Figure 6:
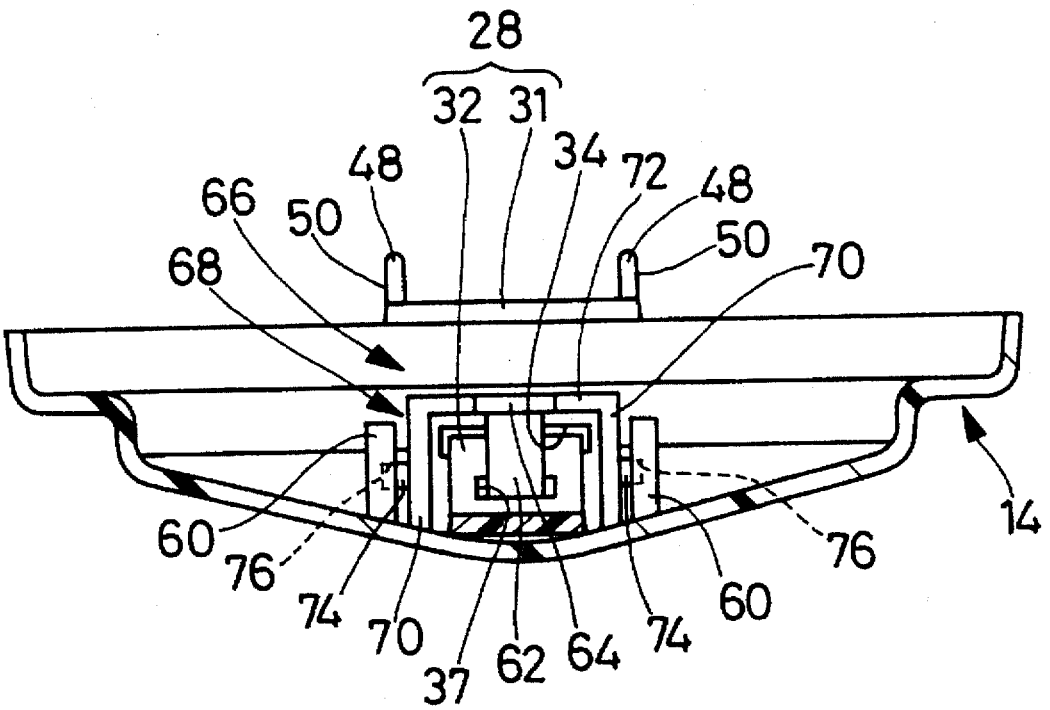
FIG. 6 is a cross-section view of the lid member of FIG. 5 as seen in a direction indicated at arrow, A.
Figure 7:
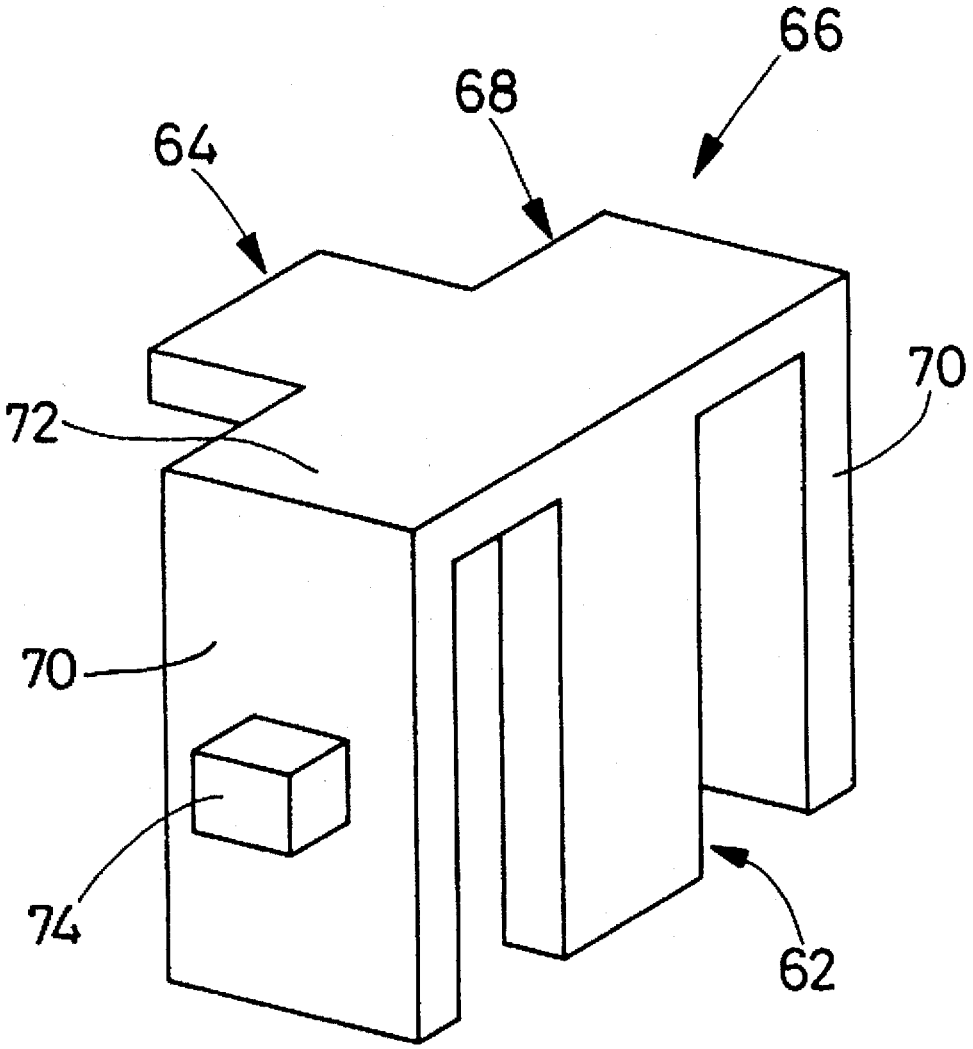
FIG. 7 is a perspective view of a biasing member provided on the lid member of FIG. 5.

Referring next to FIGS. 5, 6, and 7 there is shown a lid member 14 employed in another garbage container as a second embodiment of the present invention. The same reference numerals as used in the first embodiment shown in FIGS. 1–4 are used to designate the corresponding elements or portions of the second embodiment shown in FIGS. 5–7, and the description of those elements or portions is omitted in the following description in which only the differences between the first and second embodiments are highlighted.

As shown in FIGS. 5 and 6, in the second embodiment, there are provided a pair of projections 60, 60 between a location where a handle 22 (not shown in the figures) is formed and a location where a hook portion 31 of a movable engagement member 28 is provided, on an inner side of the lid member 14. The projections 60 are integrally formed with the lid member 14 such that the projections 60 are located on both sides of an operational portion 32 of the movable engagement member 28 as seen in a direction of width of the operational portion 32, are opposed to each other in the same direction, and project a prescribed length from an inner surface of the lid member 14. A biasing member 66 including a spring portion 62 and a hanging portion 64 is attached to the projections 60, 60.

More specifically described, as shown in FIG. 7, the biasing member 66 includes a frame member 68 in addition to the spring portion 62 and the hanging portion 64. The frame member 68 has a generally U-shaped cross section, and includes two leg portions 70, 70 each with a rectangular flat shape, and additionally includes a connection portion 72 also with a rectangular flat shape for connecting between the two leg portions 70, 70. The hanging portion 64 projects a prescribed length from a middle portion of one of two long sides of the connection portion 72, in a direction parallel to two short sides of the connection portion 72, and the spring portion 62 projects along the leg portions 70 from a middle portion of the other long side of the connection portion 72, in a direction perpendicular to the short sides of the connection portion 72. The spring and hanging portions 62, 64 are integrally formed with the leg and connection portions 70, 72, i.e., the frame member 68.

Thus, the biasing member 66 includes the hanging portion 64 projecting substantially horizontally as seen in FIG. 7, and the spring portion 62 projecting vertically downward. A lower end portion of the spring portion 62 extends into a through-hole 37 formed through the thickness of the operational portion 32 of the movable engagement member 28. The two leg portions 70 have respective engageable projections 74 which are engageable with respective engageable recesses 76 formed in the two projections 60. Thus, the biasing member 66 is provided on the inner surface of the lid member 14.

In the garbage container in accordance with the second embodiment shown in FIGS. 5–7, the lid member 14 is advantageously hung and held on a body member 12 (not shown) with the hanging portion 64 engaging a flange 18 of the body member 12. In addition, when a slide member 44 is moved to move the movable engagement member 28 in an outward direction of the lid member 14, i.e., in a direction in which the member 28 is moved toward a disengaged position where the member 28 is disengaged from the flange 18 of the body member 12, the movable member 28 is biased, with a biasing force (i.e., elastic force) of the spring portion 62 of the biasing member 66, in an inward direction of the lid member 14, i.e., in a direction in which the member 28 is moved toward an engaged position where the member 28 is engageable with the flange 18.

Thus, in the second embodiment, the biasing force of the spring portion 62 of the biasing member 66 is advantageously utilized to maintain the hook portion 31 of the movable engagement member 28 in stable engagement with the flange 18 of the body member 12. In addition, the second embodiment enjoys the same advantages as those with the first embodiment shown in FIGS. 1–4.

While the present invention has been described in its preferred embodiments, the invention may otherwise be embodied.

For example, while in the illustrated embodiments the fixed and movable engagement members 26, 28 are provided at the respective positions on the peripheral portion of the lid member 14 which are symmetrical with each other with respect to the center of the lid member 14, and are engageable with the flange 18 of the body member 12, it is possible to provide, on the body member 12, two engageable members which are engageable with the lid member 14. Otherwise, it is possible to provide, on the lid member 14, one engageable member which is engageable with the body member 12 and provide, on the body member 12, another engageable member which is engageable with the lid member 14. Furthermore, the two engageable members may be provided at respective positions other than the symmetrical positions, on the lid member 14 or the body member 12.

Although in the illustrated embodiments the two engageable members 26, 28 are used, it is possible to employ a different number of engageable members.

While in the illustrated embodiments the movable engagement member 28 is movable between the engaged position where the member 28 is engaged with the body member 12 and the disengaged position where the member 28 is disengaged from the body member 12. However, the movable engagement member 28 may be replaced by an engageable member which is displaceable (e.g., rotatable) between an engaged and a disengaged position.

In the illustrated embodiments, the fixed engagement member 26 is fixed in position with the vises to the outer or upper surface of the lid member 14. However, the engagement member 26 may be fixed in a different manner. For example, an engagement member may be adhered with an adhesive to the lid member 14 or the body member 12, or may be formed integrally with the lid or body member 14, 12.

While in the illustrated embodiments the fixed engagement member 26 is provided by the hook member 30 and the movable engagement member 28 includes the hook portion 31 and the operational portion 32, it is possible to employ, in place of the engagement members 26, 28, engageable members having shapes and structures other than those of the engagement members 26, 28, so long as the engageable members being engaged with the body member 12 can effectively prevent the lid member 14 from freely separating from the body member 12.

Although in the illustrated embodiments the slide member 44 is connected with the vis to the operational portion 32 of the movable engagement member 28, it is possible to connect the slide member 44 to the operational portion 32 in a different manner. For example, the slide member 44 may be adhered to the operational portion 32. Otherwise, the operational portion 32 of the movable engagement member 28 may be provided with a projection which projects toward the slide member 44, and the slide member 44 may have a recess in which the projection of the operational portion 32 fits. In the last case, a projection may be provided on the slide member 44 and a recess may be formed in the movable member 28. In each case, the slide member 44 is connected to the movable member 28.

In the illustrated embodiments, the slide member 44 as the operable member is movable in the outward direction of the lid member 14 and, as the slide member 44 is moved in that direction, the movable engagement member 28 is moved in the same direction to project outward over the outer peripheral edge of the lid member 14. However, it is possible to employ, in place of the slide member 44, an operable member which has a structure other than that of the slide member 44, so long as the operable member can cause a movable or displaceable engagement member to move or displace between an engaged and a disengaged position. For example, it is possible to employ an operable member which extends through a hole formed through the thickness of the lid member 14, is movable vertically through the hole, and has a lower end surface which is inclined or curved downward in a direction away from the movable engagement member 28 and is held in contact with an end face of the operational portion 32 of the movable engagement member 28. Thus, the operable member and the movable member 28 cooperate with each other to provide a cam mechanism which ensures that when the operable member is moved downward, the movable engagement member 28 is moved a prescribed distance over the outer peripheral edge of the lid member 14. In the last case, it is preferred to additionally employ a biasing device which biases the operable member in an upward direction. Thus, the operability of the operable member and accordingly the ease of use of the garbage container as a whole are much improved.

Although in the illustrated embodiments the resin-based sheet-like spring 42 or the spring portion 62 is employed as the biasing device which applies the biasing force to the movable engagement member 28 in the direction in which the member 28 is moved toward the engaged position where the member 28 is engaged with the flange 18 of the body member 12, it is possible to use, in place of the spring 42, 62, any known biasing device. For example, the biasing device may be provided by a hydraulic system or an air spring in which fluid pressure is utilized, a natural or synthetic rubber in which rubber elastic characteristic is utilized, or a metal spring such as a coil spring.

The biasing device may be used in a different way from the way employed in the first or second embodiment.

In the illustrated embodiments the respective lower surfaces of the hook member and portion 30, 31 of the fixed and movable engagement members 26, 28 are provided by the guide surfaces 48, 48 that are inclined downward in the outward direction of the lid member 14. The angle of inclination of the guide surfaces 48 is not limited. It is preferred that the angle of inclination of the guide surfaces 48 fall in the range of 20 to 25 degrees. However, the guide surfaces 48 are not essential and may be omitted.

While each of the first and second embodiments relates to a box-like garbage container having a generally rectangular cross section and formed of a synthetic resin, the principle of the present invention may advantageously be applied to other sorts of garbage containers that have other shapes and/or are formed of other materials, e.g. a cylindrical garbage container or a metallic garbage container.

It is to be understood that the present invention may be embodied with other changes, improvements, and modifications that may occur to those skilled in the art without departing from the scope and spirit of the invention defined in the appended claims.

What is claimed is:

1. A garbage container comprising:

a body member for containing garbage therein, said body member having an upper opening;

a lid member for closing said upper opening of said body member, said lid member having a handle which is formed integrally therewith and provided on an upper surface thereof, said handle being gripped with a hand of a user for moving said lid member to close or open said upper opening of said body member;

at least one engageable member which is provided on said lid member and which is engageable with said body member to prevent the lid member from separating from the body member, said engageable member including a hook portion which is engageable with an outer upper portion of said body member defining said upper opening thereof, and being movable relative to said lid member so that said hook portion thereof projects outward over an outer peripheral edge of the lid member by a predetermined distance, said engageable member further including an operational portion extending from said hook portion thereof toward said handle of the lid member; and an operable member which is slidable on said lid member relative to said handle formed integrally with the lid member, is connected to said operational portion of said engageable member, and is movable by the user for moving or displacing said engageable member between an engaged position where said hook portion of the engageable member is engaged with said outer upper portion of said body member and a disengaged position where the hook portion of the engageable member is disengaged from the outer upper portion of said body member, said operable member being provided on, or in a vicinity of, said handle of the lid member such that the operable member is accessible by the hand of the user grasping the handle.

2. A garbage container according to claim 1, wherein said at least one engageable member comprises a plurality of engageable members, a first one of said engageable members being movable or displaceable between said engaged and disengaged positions.

3. A garbage container according to claim 2, wherein said first one of said engageable members is provided at a first position on a peripheral portion of said lid member, such that said first engageable member is movable or displaceable between said engaged and disengaged positions, and a second one of said engageable members is fixed at a second position on said peripheral portion of said lid member, said second position being substantially symmetrical with said first position with respect to a center of said lid member, each of said first and second engageable members being engageable with said upper portion of said body member which portion defines said upper opening.

4. A garbage container according to claim 3, wherein said upper portion of said body member comprises an outward protruding flange, each of said first and second engageable members including said hook portion which is engageable with said flange, said first engageable member being provided on said lid member such that the hook portion of said first engageable member is movable outward over said outer peripheral edge of said lid member by said predetermined distance.

5. A garbage container according to claim 4, wherein said first engageable member includes, in addition to the hook portion thereof provided on said peripheral portion of said lid member, said operational portion extending from said hook portion thereof toward said handle of said lid member, said operable member being operable for moving said operational portion and thereby moving said first engageable member between said engaged and disengaged positions.

6. A garbage container according to claim 4, wherein the hook portion of at least one of said first and second engageable members has an inclined or curved guide surface which is inclined downward in an outward direction in which said flange of said body member protrudes.

7. A garbage container according to claim 1, further comprising a biasing device which biases said engageable member in a direction in which the engageable member is moved or displaced toward said engaged position.

8. A garbage container according to claim 7, wherein said biasing device comprises a biasing member fixed to said lid member, said biasing member including a spring portion which biases said operational portion of said engageable member so that said hook portion of the engageable member engages said upper portion of said body member, said biasing member additionally including a hanging portion which is engageable with said upper portion of said body member so that the lid member is hung and held on the body member.

9. A garbage container according to claim 1, wherein said handle comprises an elongate handle member extending in substantially the same direction as a direction in which said operational portion of said engageable member extends from said hook portion thereof toward said handle and is movable together with said operable member for moving the engageable member between said engaged and disengaged positions.

* * * * *